US005117629A

United States Patent [19]

Shaw

[11] Patent Number: 5,117,629

[45] Date of Patent: Jun. 2, 1992

[54] AXIAL FLOW COMPRESSOR

[75] Inventor: Peter A. Shaw, Derby, England

[73] Assignee: Rolls-Royce plc, London, England

[21] Appl. No.: 765,484

[22] Filed: Sep. 25, 1991

Related U.S. Application Data

[63] Continuation-in-part of Ser. No. 484,280, Feb. 26, 1990, abandoned.

[30] Foreign Application Priority Data

Apr. 5, 1989 [GB] United Kingdom ..... 8907706

[51] Int. Cl.[5] ..... F02K 3/02; F02C 6/18; F02G 3/00

[52] U.S. Cl. ..... 60/226.1; 60/39.07; 415/115

[58] Field of Search ..... 60/226.1, 39.07; 415/108, 126, 127, 173.1, 173.2, 173.3, 174.1, 115

[56] References Cited

U.S. PATENT DOCUMENTS

| | | | |
|---|---|---|---|
| 4,472,108 | 9/1984 | Pask | 415/173.3 |
| 4,529,355 | 7/1985 | Wilkinson | 415/173.1 |
| 4,596,116 | 6/1986 | Mandet et al. | 60/39.07 |
| 4,683,716 | 8/1987 | Wright et al. | 60/226.1 |
| 4,696,619 | 9/1987 | Lardellier | 415/173.2 |
| 5,048,288 | 9/1991 | Bessette et al. | 60/226.1 |
| 5,056,988 | 10/1991 | Corsmeier | 415/126 |

FOREIGN PATENT DOCUMENTS

| | | | |
|---|---|---|---|
| 0230177 | 7/1987 | European Pat. Off. . | |
| 1428228 | 9/1969 | Fed. Rep. of Germany . | |
| 59-90706 | 5/1984 | Japan | 415/127 |
| 741549 | 12/1955 | United Kingdom . | |
| 987625 | 3/1965 | United Kingdom . | |
| 1028444 | 5/1966 | United Kingdom . | |
| 2048386 | 10/1980 | United Kingdom . | |
| 2169962 | 7/1986 | United Kingdom . | |

*Primary Examiner*—Richard A. Bertsch
*Assistant Examiner*—Howard R. Richman
*Attorney, Agent, or Firm*—Cushman, Darby & Cushman

[57] ABSTRACT

An axial flow compressor with an inner casing and an outer casing. The inner casing has bleed apertures. The outer casing is provided with loading devices which are positioned adjacent to the bleed apertures such that the loading devices apply loads on the inner casing in the vicinity of the bleed apertures. Components of the loads applied by the loading devices are arranged to oppose and preferably balance any loads applied on the inner casing due to the bleed apertures' releasing the pressure differential across the inner casing. The loading devices comprise cylinders secured to the inner casing and pistons secured to the outer casing to form chambers. The chambers are supplied with fluid at a predetermined pressure. The loading devices oppose undesirable local reductions in clearance between static shrouds and the rotor blades. In one embodiment, the pressure inside the inner casing is a relatively high pressure, the pressure between the inner and outer casings is a lower pressure, and the predetermined pressure supplied to the chambers of the loading devices is a still lower pressure.

15 Claims, 3 Drawing Sheets

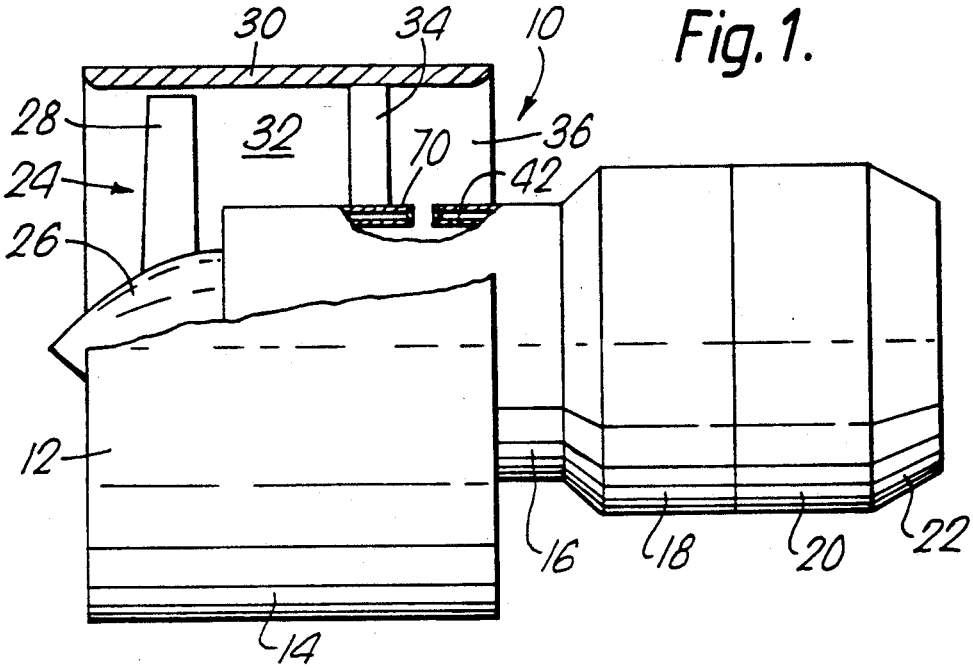
Fig. 1.
Fig. 4.
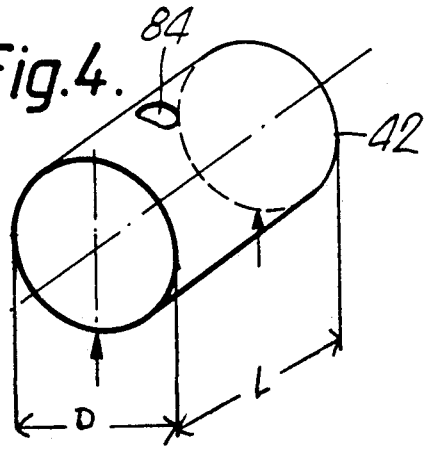
Fig. 5.
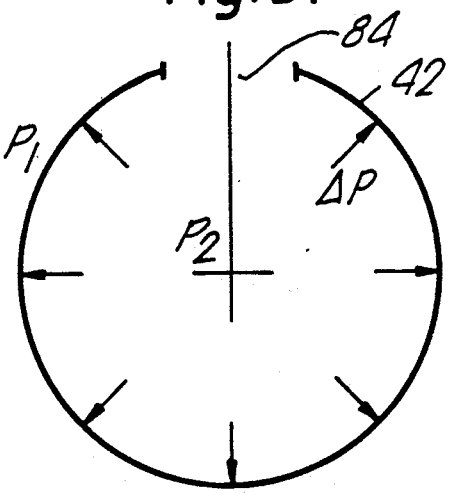
Fig. 6.
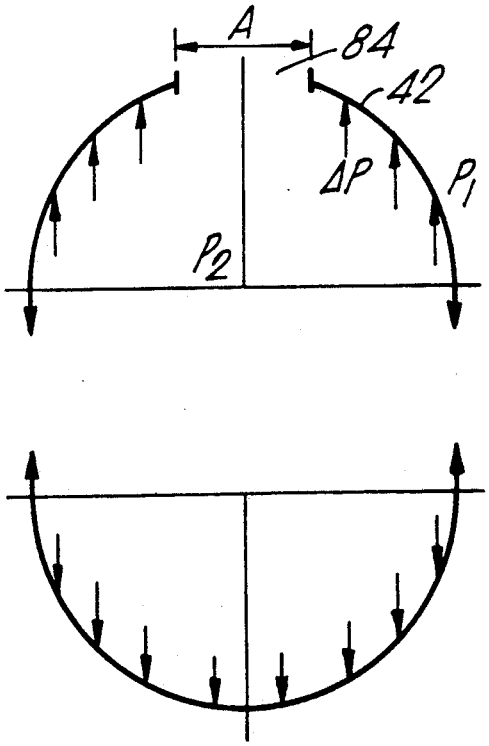

AXIAL FLOW COMPRESSOR

This is a continuation-in-part of application Ser. No. 07/484,280, filed on Feb. 26, 1990, which was abandoned upon the filing hereof.

BACKGROUND OF THE INVENTION

The present invention relates to axial flow compressors.

In axial flow compressors it is common practice to provide bleed offtakes in order to bleed working fluid from the compressor for various purposes. In axial flow compressors of gas turbine engines, working fluid is commonly bled from the axial flow compressor for cooling turbines, gearboxes, bearings or for supplying to an associated aircraft cabin air supply.

In axial flow compressors it is desirable to maintain a uniform small clearance between the rotor blade tips and the encircling static shroud, and to minimize the variations in the clearance between the rotor blade tips and the static shroud.

The use of bleed offtakes has resulted in a problem affecting the small clearance between the rotor blade tips and the static shroud. The bleeding of working fluid from the compressor has resulted in a local reduction of the clearance between the static shroud and the rotor blade tips in a circumferential half of the compressor in which the bleed offtake is positioned.

SUMMARY OF THE INVENTION

The present invention therefore seeks to provide an axial flow compressor with a bleed offtake in which the local reduction of clearance between the static shrouds and rotor blade tips is reduced.

Accordingly, the present invention provides an axial flow compressor comprising a rotor having at least one stage of circumferentially spaced radially outwardly extending rotor blades, an inner casing having a shroud structure, the shroud structure extending circumferentially and being spaced radially from the rotor blades by a clearance, an outer casing being positioned coaxially with and spaced radially outwardly from the inner casing, an annular chamber being formed between the inner casing and the outer casing, the annular chamber being supplied with working fluid at a first predetermined pressure, a bleed offtake being arranged to bleed working fluid at a second predetermined pressure from within the inner casing, the inner casing having a first bleed aperture, the outer casing having a second bleed aperture, a bleed duct being arranged to extend radially between and to seal with the first bleed aperture in the inner casing and the second bleed aperture in the outer casing, which results in the imposition of a non-axis symmetric radial load on the inner casing, the first predetermined pressure being greater or less than the second predetermined pressure, loading means arranged to apply a non-axis symmetric radial load on the inner casing such that any load acting on the inner casing due to the provision of the bleed apertures is at least reduced by the load acting on the inner casing due to the loading means to oppose local non-axis symmetric reductions of the clearance between the shroud structure and the rotor blades.

The loading means comprise a first loading means positioned circumferentially on a first side of the bleed duct, a second loading positioned circumferentially on a second side of t duct, the first and second loading means being to apply loads on the inner casing at predetermined angles circumferentially from the bleed duct such that any load acting on the inner casing due to the provision of the bleed duct is at least reduced by components of the loads acting on the inner casing due to the first and second loading means to oppose local reductions of the clearance between the shroud structure and the rotor blades.

The first loading means may comprise a first cylinder and a first piston, the first piston being arranged coaxially within the first cylinder to define a first chamber, the first chamber being supplied with working fluid at a third predetermined pressure, the second loading means comprises a second cylinder and a second piston, the second piston being arranged coaxially within the second cylinder to define a second chamber, the second chamber being supplied with working fluid at a fourth predetermined pressure, both the third predetermined pressure and the fourth predetermined pressure being greater or less than the first predetermined pressure, the first piston being secured to one of the inner casing or outer casing, the first cylinder being secured to the other of the inner casing or outer casing, the second piston being secured to one of the inner casing or outer casing, the second cylinder being secured to the other of the inner casing or outer casing, the axes of the first cylinder and the, second cylinder being arranged at a predetermined angle circumferentially from the bleed duct such that any load acting on the inner casing due to the provision of the bleed apertures is at least reduced by loads acting on the inner casing due to the pressure difference between the working fluid in the first and second chambers and the working fluid within the inner casing.

The first cylinder may be secured to the inner casing and the first piston is secured to the outer casing.

The second cylinder may be secured to the inner casing and the second piston is secured to the outer casing.

The axes of the first cylinder, the second cylinder, the first bleed aperture, and the second bleed aperture may be arranged to lie in a plane.

The first and second cylinders may be arranged at equal angles circumferentially from the bleed duct.

The third and fourth pressures may be equal.

The axes of the first and second cylinders may be arranged at an angle of 21° from the axis of the bleed duct or at an angle of 18.5° from the axis of the bleed duct.

BRIEF DESCRIPTION OF THE DRAWINGS

The present invention will be more fully described by way of example with reference to the accompanying drawings, in which:

FIG. 1 is a partially cut away view of a turbofan gas turbine engine having a compressor according to the present invention.

FIG. 4 is a diagrammatic perspective view of an inner compressor casing in FIGS. 2 and 3.

FIGS. 5 and 6 are diagrammatic cross-sectional views of the inner compressor casing in FIG. 4.

DETAILED DESCRIPTION OF THE PREFERRED EMBODIMENT

Figure 2:
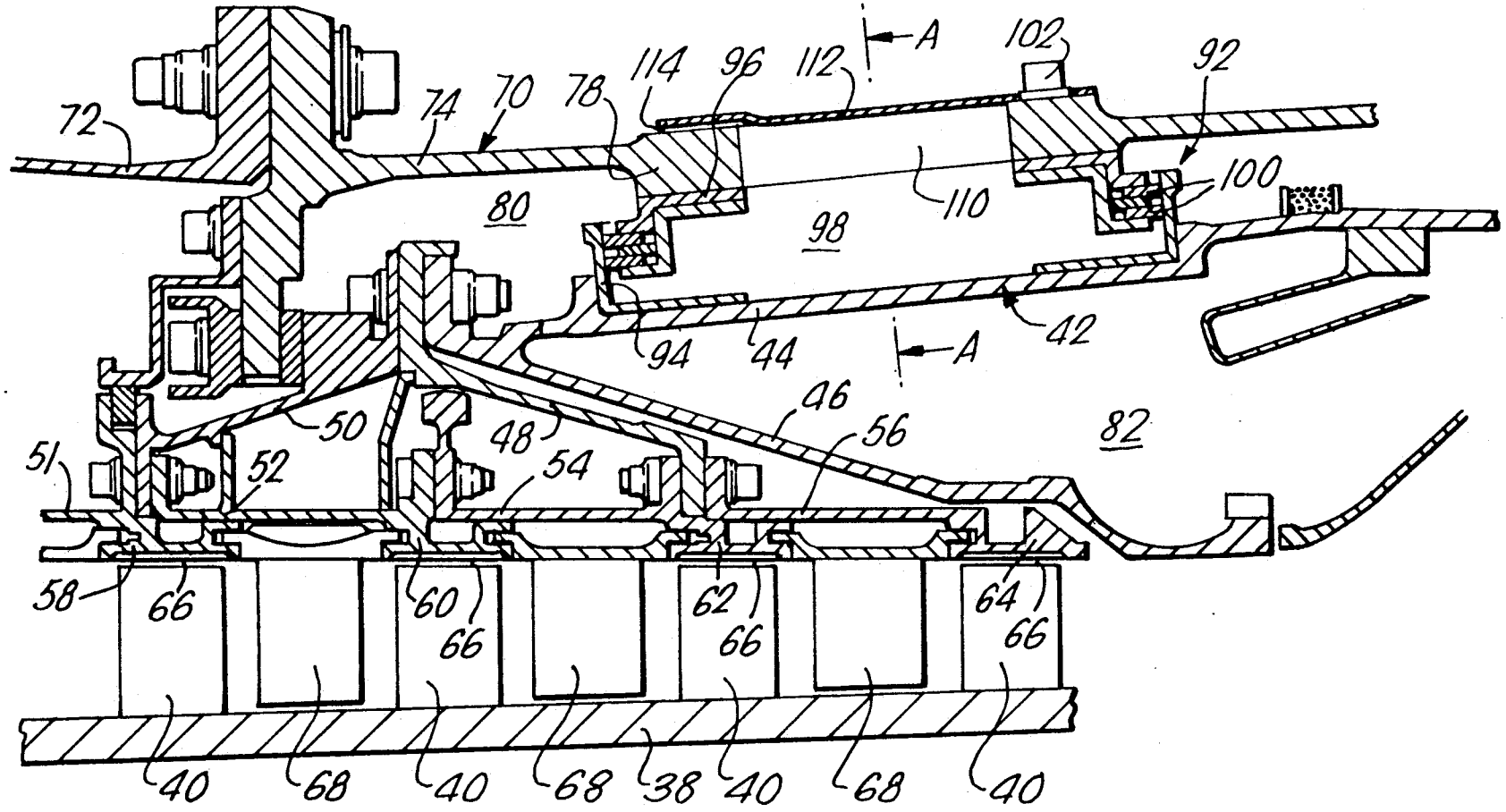
FIG. 2 is an enlarged longitudinal cross-sectional view of the compressor in FIG. 1.

A turbofan gas turbine engine 10 is shown in FIG. 1, and comprises in axial flow series an inlet 12, a fan section 14, a compressor section 16, a combustor section 18, a turbine section 20 and an exhaust nozzle 22. The fan section 14 comprises a fan assembly 24 positioned coaxially in a fan casing 30. The fan assembly 24 comprises a fan rotor 26 which has a plurality of circumferentially arranged radially outwardly extending fan blades 28. A fan duct 32 is defined between the fan casing 30 and the core engine casing. The fan duct 32 has an outlet 36 at its downstream end. The fan casing 30 is secured to the core engine casing by a plurality of circumferentially arranged outlet guide vanes 34.

The turbofan gas turbine engine 10 operates quite conventionally in that air flows into the inlet 12, and is initially compressed by the fan section 14. The air flow is then divided and a first portion of the air flows through the compressor section 16 and is further compressed before being supplied to the combustor section 18. Fuel is injected into the combustor section 18 and is burnt in the air supplied from the compressor section 16 to produce hot gases. The hot gases flow through and drive the turbine section 20 before passing through the exhaust nozzle 22 to atmosphere. The second portion of air bypasses the core of the turbofan gas turbine engine 10 and flows through the bypass duct 32 to the bypass duct outlet 36. The turbine section 20 drives the fan section 14 and the compressor section 16 via shafts (not shown).

Figure 3:
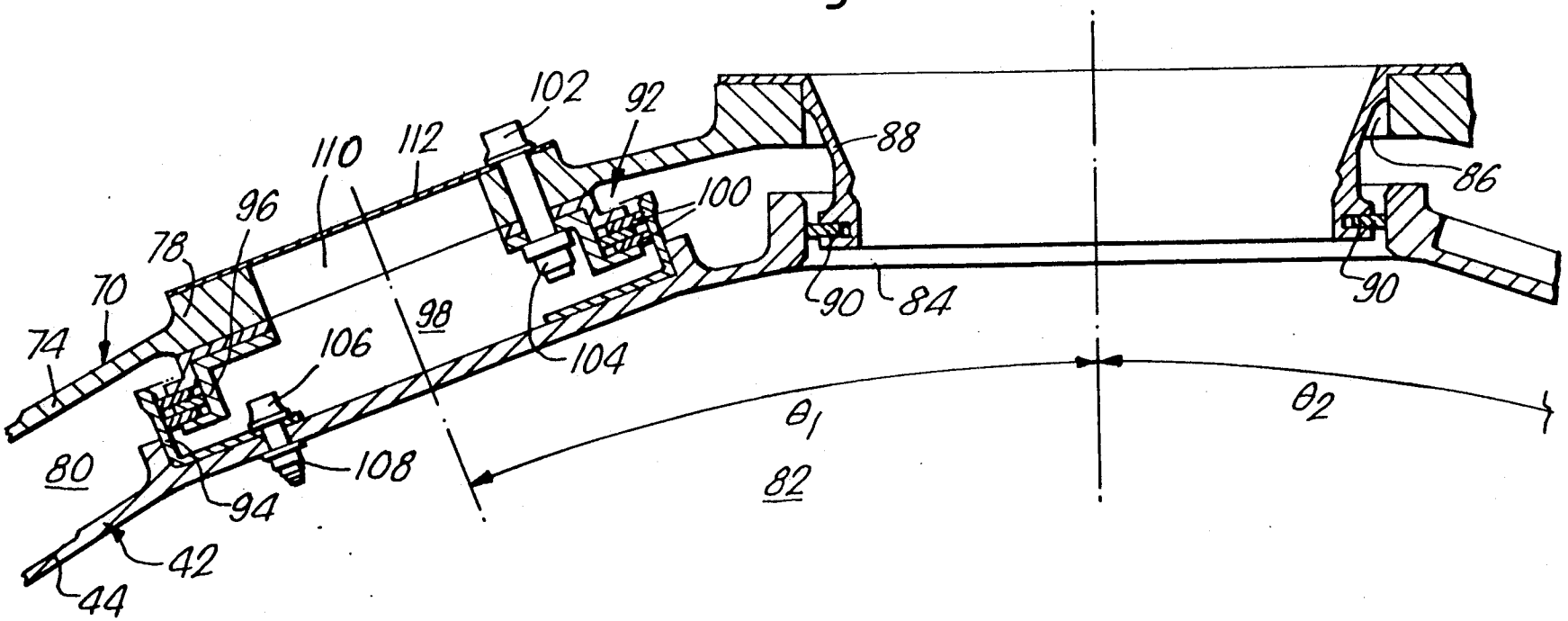
FIG. 3 is a partial cross-sectional view in the direction of arrows A—A in FIG. 2.

The compressor section 16 is shown more clearly in FIGS. 2 and 3. The compressor section 16 comprises a rotor 38 which has a plurality of stages of rotor blades 40 secured thereto. The stages of rotor blades 40 are spaced apart axially on the rotor 38, and the rotor blades 40 in each stage are circumferentially spaced and extend radially outwardly from the rotor 38.

The compressor section 16 also has a static structure. The static structure comprises an inner casing 42 and an outer casing 70, the inner and outer casings 42 and 70 are arranged coaxially with the rotor 38. The inner casing 42 comprises a number of annular casing portions 44,46,48 and 50 which are secured together. The casing portions 44,46,48 and 50 carry a number of annular channel section members 51,52,54 and 56 which are secured together at bolted flange joints. The annular channel section members 51,52,54 and 56 have shroud structures 58,60,62 and 64 respectively, which are spaced radially from the outermost tips of the rotor blades 40 by a small clearance 66. The outer casing 70 is spaced radially outwardly from the inner casing 42 and the outer casing 70 comprises a number of annular casing portions 72 and 74 which are secured together.

A first annular chamber 80 is formed between the inner casing 42 and the outer casing 70, and a second annular chamber 82 is formed within the inner casing 42. The first annular chamber 80 is supplied with air compressed by the compressor, the air is at a first predetermined pressure, and in this example is bled from the third stage of the high pressure compressor. The second annular chamber 82 is supplied with air compressed by the compressor, the air is at a second predetermined pressure, and in this example is bled from the sixth or final stage of the high pressure compressor.

The inner casing portion 44 has a first bleed aperture 84 and the outer casing portion 74 has a second bleed aperture 86, which is coaxial with the first bleed aperture 84. A bleed duct 88 is arranged coaxially with the first and second bleed apertures 84,86 and extends radially between and seals with the first bleed aperture 84 in the inner casing 42, and seals with the second bleed aperture 86 in the outer casing 70. The bleed duct 88 is secured to the outer casing 70, but is not secured to the inner casing 42, the radially inner end of the bleed duct 88 seals with the first bleed aperture 84 in the inner casing 42 by means of a ring seal 90.

As shown in the cross-sectional view of FIG. 3, the bleed duct 88 is arranged to bleed compressed air at the second predetermined pressure from the second annular chamber 82 within the inner casing 42 and to supply the compressed air for various purposes, for example cooling of engine turbines, gearboxes, bearings or for supplying to an associated aircraft cabin air supply.

A bleed valve (not shown) is provided to control the flow of bleed air from the compressor.

However, as mentioned previously, this bleeding of compressed air results in a local reduction of the clearance between the static shrouds and the tips of the rotor blades in the circumferential half of the compressor in which the bleed duct is positioned. This bleeding of air from the compressor does not, by itself, cause the local reduction in clearance, however. The problem arises due to the provision of the bleed duct.

FIGS. 4 to 6 show the inner casing 42 and the first bleed aperture 84. The compressed air outside of the inner casing 42 in the first annular chamber 80 is at a first predetermined pressure $P_1$ and the compressed air inside the inner casing 42 in the second annular chamber 82 is at a second predetermined pressure $P_2$. The second predetermined pressure $P_2$ is greater than the first predetermined pressure $P_1$ by a difference $\Delta P$.

If the loads on the two half casings are considered as in FIGS. 4 and 6, if the inner casing 42 has a diameter of D and a length of L then the load on the bottom half of the casing is $\Delta P \times D \times L$. If the area of the first bleed aperture is A then the load on the top half of the casing is $\Delta P \times D \times L$. There is a load mismatch between the top half of the casing and the bottom half of the casing resulting in a downward load of $\Delta P \times A$ on the casing. This load acting on the inner casing due to the difference in pressure between the inside and outside of the inner casing and the provision of a bleed aperture in the inner casing is the cause of the local reduction of the clearance between the shrouds and rotor blade tips in the half of the compressor in which the bleed duct is centrally positioned.

The pressures $P_1$ and $P_2$ in the annular chambers 80 and 82 respectively, and the load which causes the distortion of the inner casing 42 are present whenever the engine is running. The pressure $P_2$ in chamber 82 falls slightly when air is being bled from the compressor, usually during descent and hold of a gas turbine engine mounted to an associated aircraft. The greatest load acting on the inner casing 42 occurs during take-off when the bleed valve is closed preventing an air bleed flow from the compressor.

In order to reduce, or preferably minimize the local reduction of the clearance between the shroud structure and the tips of the rotor blades due to this effect, first and second loading devices 92 are provided. The first loading device 92 is positioned on a first side of the bleed duct 88, and is spaced circumferentially from the bleed duct 88 by an angle $\theta_1$, similarly the second loading device 92 is positioned on a second side of the bleed duct 88, and is spaced circumferentially from the bleed duct 88 by an angle $\theta_2$. The first and second loading devices 92 are arranged to apply loads on the inner casing 42 at predetermined angles of $\theta_1$ and $\theta_2$ circumferentially from the bleed duct 88 such that the load acting on the inner casing 42 due to compressed air being bled from the second annular chamber 82 is reduced by components of the loads acting on the inner casing 42 due to the first and second loading devices 92 to oppose the local reductions of the clearance between the shroud structure and the rotor blades.

Each loading device 92 comprises a cylinder 94 which is secured to the inner casing portion 44 by nuts 106 and bolts 108 or other suitable fastening means, and a piston 96 which is secured to a boss 78 on the outer casing portion 74 by nuts 102 and bolts 104 or other suitable fastening means. Each piston 96 is arranged coaxially within the respective cylinder 94 to define a chamber 98. The axes of the cylinders 94 are arranged to extend radially. The pistons 96 are provided with one or more sealing rings 100 which form a seal between the pistons 96 and the cylinders 94. The bosses 78 are provided with apertures 110 which supply compressed air at a predetermined pressure from the compressor into the chambers 98. The predetermined pressure of the air supplied to the chambers 98 is less than the predetermined pressure of the air in the first annular chamber 80. A seal plate 112 is secured over each aperture 100 but a small vent 114 is allowed.

The air supplied to the chambers 98 is preferably supplied from the fan duct 32 downstream of the fan blades 28, however it may also be possible to use air supplied from the compressor at any suitable position upstream of the third stage of the high pressure compressor.

The angles $\theta_1$ and $\theta_2$, and the predetermined pressure of the air supplied to the chambers 98 are chosen so that the loads applied on the inner casing by the loading devices balances the loads on the inner casing due to the provision of a bleed duct for bleeding of air from the second annular chamber 82. The loading devices are arranged such that the angles $\Delta_1$ and $\Delta_2$ from the bleed duct 88 are equal and the pressure of the air supplied to the chambers 98 are arranged to be equal. However, balancing may be achieved using different angles and different pressures.

It may equally well be possible to secure the pistons to the inner casing and the cylinders to the outer casing.

The cylinders are arranged at angles of 21° or 18.5° from the bleed aperture 84, however other suitable angles may be used.

I claim:

1. An axial flow compressor comprising a rotor having at least one stage of circumferentially spaced radially outwardly extending rotor blades, a casing carrying a shroud structure, the shroud structure extending circumferentially and being spaced radially from the rotor blades by a clearance, the casing at least partially defining an outer extremity of an annular chamber, the annular chamber being supplied with working fluid at a predetermined pressure from the compressor, the casing having a bleed aperture extending from the annular chamber to outside the casing, a bleed offtake being arranged to bleed working fluid at the predetermined pressure from the annular chamber, the bleed offtake comprising a bleed duct extending from and sealing with the bleed aperture, a pressure difference existing between the predetermined pressure in the annular chamber and a pressure outside the casing, loading means being arranged to apply an opposing nonaxisymmetric load on the casing such that any nonaxisymmetric load acting on the casing due to the provision of the bleed aperture is at least reduced to oppose a nonaxisymmetric reduction of the clearance between the shroud structure and the rotor blades.

2. The compressor of claim 1 wherein said pressure outside the casing is a pressure inside another annular chamber, said another annular chamber being at least partially defined by the casing.

3. An axial flow compressor comprising a rotor having at least one stage of circumferentially spaced radially outwardly extending rotor blades, an inner casing having a shroud structure, the shroud structure extending circumferentially and being spaced radially from the rotor blades by a clearance, the inner casing having a first bleed aperture, an outer casing being positioned coaxially with and spaced radially outwardly from the inner casing, the outer casing having a second bleed aperture, the inner casing and outer casing defining therebetween a first annular chamber, the first annular chamber being supplied with working fluid at a first predetermined pressure, the inner casing also at least partially defining a second annular chamber being supplied with working fluid at a second predetermined pressure, a bleed offtake being arranged to bleed working fluid at the second predetermined pressure from the second annular chamber through a bleed duct sealingly connected between the first bleed aperture and the second bleed aperture, the first predetermined pressure being greater or less than the second predetermined pressure, loading means being arranged to apply an opposing nonaxisymmetric radial load on the inner casing to at least partially counteract a nonaxisymmetric radial load acting on the inner casing due to the provision of the first bleed aperture which causes deformation of the inner casing and a resulting nonaxisymmetric reduction of the clearance between the shroud structure and the rotor blades.

4. A compressor as claimed in claim 3 in which the loading means comprises a first loading means positioned circumferentially on a first side of the bleed duct, a second loading means positioned circumferentially on a second side of the bleed duct, the first and second loading means being arranged to apply loads on the inner casing at predetermined angles circumferentially from the bleed duct.

5. A compressor as claimed in claim 4 in which the first loading means comprises a first cylinder and a first piston, the first piston being arranged coaxially within the first cylinder to define a first chamber, the first chamber being supplied with working fluid at a third predetermined pressure, the second loading means comprises a second cylinder and a second piston, the second piston being arranged coaxially within the second cylinder to define a second chamber, the second chamber being supplied with working fluid at a fourth predetermined pressure, both the third predetermined pressure and the fourth predetermined pressure being greater or less than the first predetermined pressure, the first piston being secured to one of the inner casing and outer casing, the first cylinder being secured to the other of the inner casing and outer casing, the second piston being secured to one of the inner casing and outer casing, the second cylinder being secured to the other of the inner casing and outer casing, the axes of the first cylinder and the second cylinder being arranged at a predetermined angle circumferentially from the bleed duct such that the nonaxisymmetric radial load acting on the inner casing due to the provision of the first bleed aperture is at least reduced due to the pressure difference between the working fluid in the first and second annular chambers and the working fluid within the inner casing.

6. A compressor as claimed in claim 5 in which the axes of the first and second cylinders are arranged to extend radially.

7. A compressor as claimed in claim 5 in which the first cylinder is secured to the inner casing and the first piston is secured to the outer casing.

8. A compressor as claimed in claim 5, in which the second cylinder is secured to the inner casing and the second piston is secured to the outer casing.

9. A compressor as claimed in claim 5 in which the axes of the first cylinder, the second cylinder, and the two bleed apertures are arranged to lie in a plane.

10. A compressor as claimed in claim 5 in which the first and second cylinders are arranged at equal angles circumferentially from the bleed duct.

11. A compressor as claimed in claim 5 in which the third and fourth pressures are equal.

12. A compressor as claimed in claim 9 in which the axes of the first and second cylinders are arranged at an angle of approximately 21° from the axis of the bleed duct.

13. A compressor as claimed in claim 9 in which the axes of the first and second cylinders are arranged at an angle of approximately 18.5° from the axis of the bleed duct.

14. A gas turbine engine comprising a compressor as claimed in claim 3.

15. A gas turbine engine including a compressor as claimed in claim 13 in which the gas turbine engine is a turbofan, the turbofan having a fan positioned coaxially in a fan casing, the working fluid at the third and fourth predetermined pressures being supplied from a position downstream of the fan.

* * * * *